US006688030B2

(12) United States Patent
Vihos

(10) Patent No.: US 6,688,030 B2
(45) Date of Patent: Feb. 10, 2004

(54) ENCASEMENT SYSTEM

(76) Inventor: Georg A. Vihos, 2732 Yemans St., Hamtramck, MI (US) 48212

( * ) Notice: Subject to any disclaimer, the term of this patent is extended or adjusted under 35 U.S.C. 154(b) by 118 days.

(21) Appl. No.: 09/925,064

(22) Filed: Aug. 8, 2001

(65) Prior Publication Data

US 2003/0029069 A1 Feb. 13, 2003

(51) Int. Cl.[7] ..... B65D 81/26; A47G 1/06
(52) U.S. Cl. ..... 40/718; 206/213.1; 206/204
(58) Field of Search ..... 40/718; 206/213.1, 206/204

(56) References Cited

U.S. PATENT DOCUMENTS

| | | | | |
|---|---|---|---|---|
| 1,031,727 A | | 7/1912 | Mussbeck | |
| 1,881,046 A | | 10/1932 | Dieterle | |
| 3,585,748 A | | 6/1971 | Schneider et al. | |
| 3,673,722 A | | 7/1972 | Robertson | |
| 3,983,650 A | * | 10/1976 | Payson | 40/737 |
| 4,183,160 A | | 1/1980 | Brodersen | |
| 4,646,914 A | * | 3/1987 | Gipson | 206/213.1 |
| 4,848,014 A | | 7/1989 | Yesbick | |
| 5,205,059 A | | 4/1993 | Doll | |
| 5,640,793 A | | 6/1997 | Fischer | |
| 5,787,625 A | | 8/1998 | Yesbick | |
| 5,815,971 A | | 10/1998 | Rothe et al. | |
| 6,158,828 A | * | 12/2000 | Vacovsky et al. | 40/800 |

FOREIGN PATENT DOCUMENTS

| | | | | |
|---|---|---|---|---|
| JP | 41110398 A | * | 4/1999 | A47G/1/06 |

* cited by examiner

*Primary Examiner*—Cassandra H. Davis

(57) ABSTRACT

An encasement system for a display article comprising a transparent top section, a bottom section, a side section disposed directly adjacent the transparent top section and bottom section, the side section having an extending arm, the extending arm having a top segment and a bottom segment and a channel defined there between, whereby a cavity is defined between the transparent top section, bottom section and side section for receiving the display article and whereby the channel is in communication with the cavity, an inert gas injected into the cavity through the channel; and a means for attaching the transparent top section to the side section and to the bottom section such that the inert gas is sealed inside the cavity between the transparent top section and bottom section and adjacent the side section.

6 Claims, 8 Drawing Sheets

ENCASEMENT SYSTEM

TECHNICAL FIELD

This invention relates to an encasement system for various types of display articles and more particularly to an airtight encasement system for use in protecting display articles from detrimental environmental elements.

BACKGROUND ART

It is known that certain articles displayed over time begin to show the effects of harmful environmental elements. More particularly, certain display articles namely, works of art such as paintings, sketches, lithographs, pictures, drawings and certain works of historical significance require special care in their display mechanism. These works of art are, in most instances, meant for public display. Similarly, works of historical significance are often coveted by the public and provide a basis for historical education and are therefor often displayed in various fashions in public areas for viewing. Similarly, certain family documents, such a family photographs, certificates, graduation documents and other noted articles are often displayed for the benefit of all the family members and guests. Lastly, certain display articles such as collectable items like, famous signatures, famous photographs, baseball cards, special or first edition magazines and comic books etc. are often of such importance or significance that a special display environment is desired.

These works of art, works of history, family documents and collectibles and other display articles are often flat articles made from or prepared on paper products. It is known that exposure to the air and sunlight have a detrimental deteriorating effect on the paper, colors, pigments and other aspects of the articles. U.S. Pat. No. 1,031,727 to Brusbeck discloses a means for preserving works of art such as oil paintings, water color paintings, graphic objects and similar articles. The invention consists in furnishing the article to be protected with an envelope of nitrogen gas and in providing a casing of peculiar construction which is adapted to contain the article and to be charged with gas.

U.S. Pat. No. 4,183,160 assigned to applicant discloses a mount for a display object including drawings, paintings, thin sheets or other large thin sheets comprising a pair of opposed rectangular flexible plastic sheets arranged face to face and adapted to receive the display object there between. At lest one of the sheets is transparent. The sheets have continuous opposed peripheral inner walls with peripheral recesses formed in the walls defining a peripheral cavity. A sealant fills the cavity throughout 360 degrees for securing and sealing together the sheets around the periphery. The space between the sheets is evacuated with the display object operatively sealed between the sheets. U.S. Pat. No. 4,848,014 to Yesbick discloses a frame assembly wherein the frame and viewing area are integrally formed of clear plastic or plexiglass eliminating the need for a separate glass pane.

Consequently, a need exists for a low cost, easy to manufacture, highly reliable encasement system for a display articles that protects such articles from detrimental effects of the general environment.

DISCLOSURE OF THE INVENTION

It is a principal object of the present invention to provide and encasement system for a display article that is reliable in its ability to protect certain display articles from the detrimental effects of the environment.

It is a further object of the present invention to provide encasement system for a display article which is simple and easy to manufacture.

It is still another object of the present invention to provide an encasement system for a display article which is of relatively low cost and is thus affordable for all types of display articles from an irreplaceable work art to an important family document or photograph.

It is yet another object of the present invention to provide an encasement system for a display article which uses an inert gas in a sealed display environment for long term protection of the display article.

Yet still further, it is an object of the present invention to provide an encasement system using an ultraviolet protectant acrylic substrate capable of filtering ultraviolet light.

Yet another object of the present invention is to provide an encasement system using an ultraviolet protectant acrylic substrate capable of filtering ultraviolet light to provide a "non-yellowing" optically clear environment for the display article and also protect the display article from degradation due to the atmosphere and bacteria and contaminants.

Still further, it is an object of the present invention to provide an encasement system using an ultraviolet adhesive sealant to seal and connect different sections of the encasement system.

Yet another object of the present invention is to provide an oxygen indicator filament within the encasement system to indicate certain predetermined oxygen level for use in monitoring the capabilities of the encasement system.

It is still a further object of the present invention to provide an encasement system utilizing a method of purging the air surrounding the display article and replacing the air with an inert gas.

In carrying out these and other objects, features and advantages of the present invention, there is provided an encasement system for a display article comprising a transparent top section, a bottom section having a cavity defined for receiving the display article and a channel in communication with the cavity, an inert gas injected into the cavity through the channel and a means for attaching the transparent top section to the bottom section such that the inert gas is sealed inside the cavity between the transparent top section and bottom section.

In a preferred embodiment of the encasement system the inert gas is Argon.

In an alternative embodiment of the encasement system the inert gas is Nitrogen.

In yet another embodiment, the encasement system comprises an a transparent top section, a bottom section, a side section disposed directly adjacent the transparent top section and bottom section, the side section having an extending arm, the extending arm having a top segment and a bottom segment and a channel defined there between, whereby a cavity is defined between the transparent top section, bottom section and side section for receiving the display article and whereby the channel is in communication with the cavity; an inert gas injected into the cavity through the channel; and a means for attaching the transparent top section to the side section and to the bottom section such that the inert gas is sealed inside the cavity between the transparent top section and bottom section and adjacent the side section, wherein the extending arm includes a top sealant canal defined on the top segment and a bottom sealant canal defined on the bottom segment wherein the top segment contacts the transparent top section and the bottom segment contacts the bottom section and the means for attaching the transparent top section to the bottom section is an ultraviolet adhesive sealant disposed in the top sealant canal contacting the top section and an ultraviolet adhesive sealant disposed in the bottom sealant canal contacting the bottom section.

The above objects and other objects, features and advantages of the present invention are readily apparent from the following detailed description of the best mode for carrying out the invention when taken in connection with the accompanying drawings.

BEST MODE FOR CARRYING OUT THE INVENTION

Figure 1:
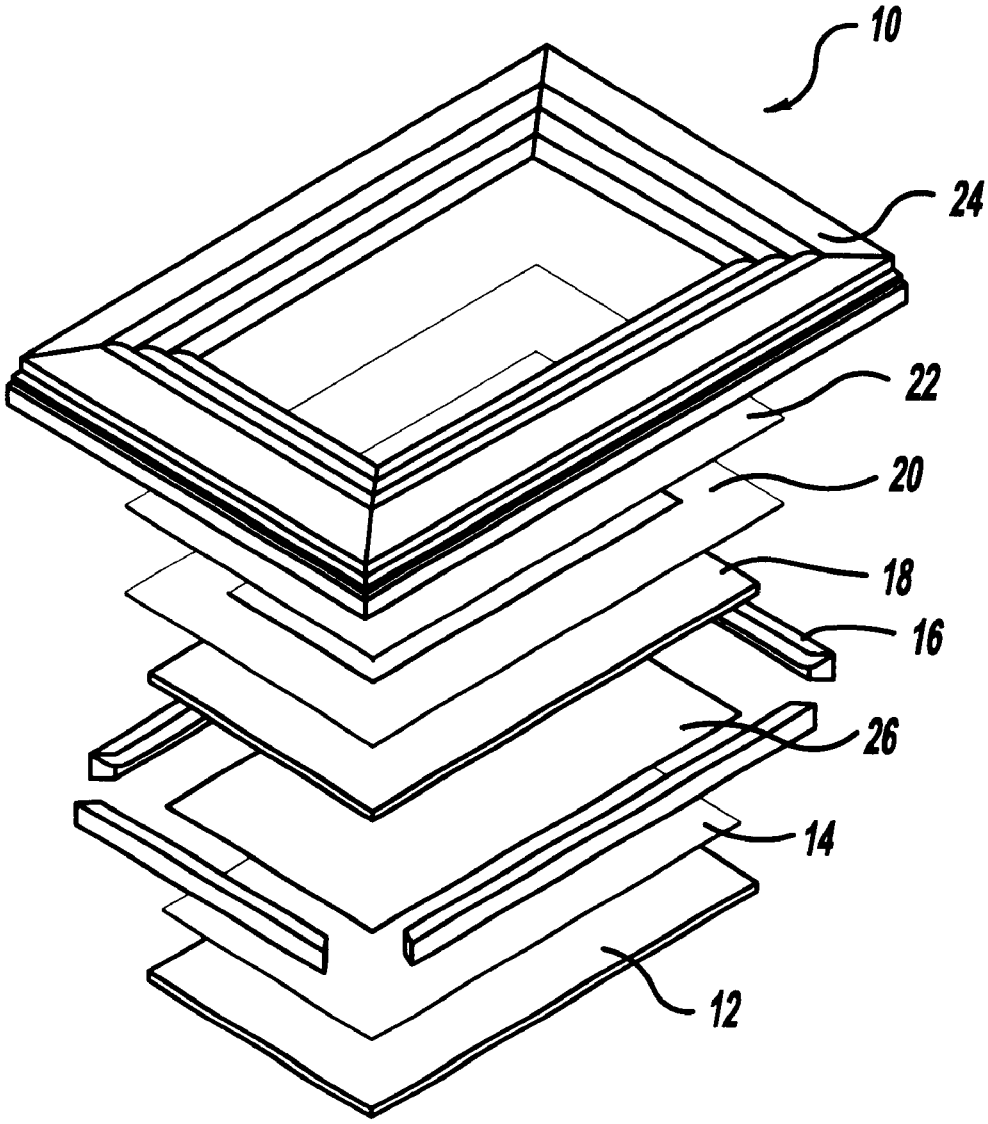
FIG. 1 is a perspective, exploded view of the encasement system of the present invention.
Figure 3:
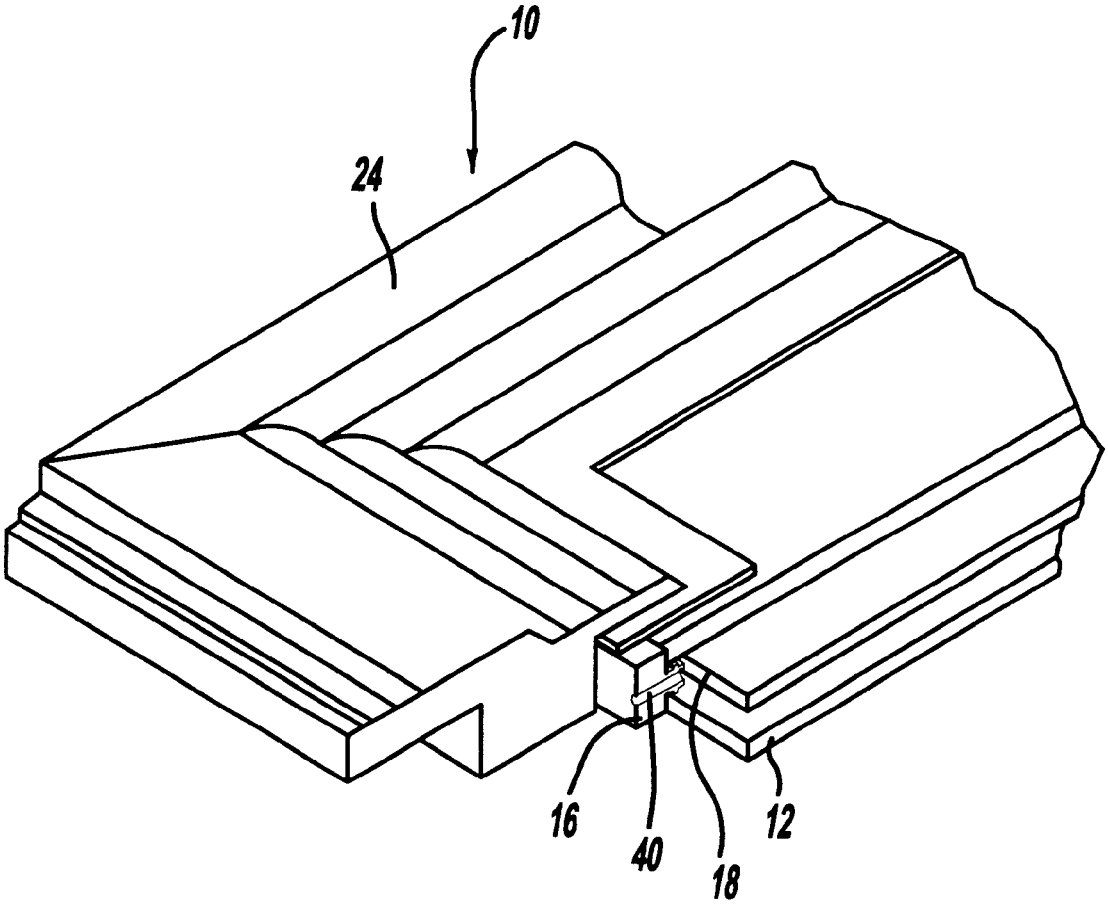
FIG. 3 is a perspective, partial view of the encasement system of the present invention.

FIG. 1 illustrates the encasement system 10 of the present invention. In this embodiment of the present invention, the encasement system 10 comprises a bottom acrylic sheet or bottom section 12, an oxygen indicator filament 14, the side frame or side section 16, and a transparent top acrylic sheet or top section 18. The top acrylic top section is made from Acrylite OP-2 Museum Quality ultraviolet filter sheets. The present invention contemplates the use of any transparent or semi-transparent ultraviolet filtering sheets depending on the specific display article to be protected and the length of protection required. A mat formation 20, additional glass encasement 22 and frame 24 are also shown in this embodiment. The frame 24 can be used for traditional hangings. The display article 26, in this embodiment is a representative piece of artwork, but as described above the display articles may be works of art such as paintings, sketches, lithographs, pictures, drawings or any other artistic works. Display articles may also be certain works of historical significance requiring special care in their display mechanism. The present invention also contemplates any form of family documents, such a family photographs, certificates, graduation documents and other noted articles often displayed for the benefit of all the family members and guests. Lastly, the present invention contemplates certain display articles such as collectable baseball cards, special or first edition magazines or comic books etc. where a protective special display environment is desired. FIG. 3 illustrates the encasement system in a fully sealed state.

Figure 2:
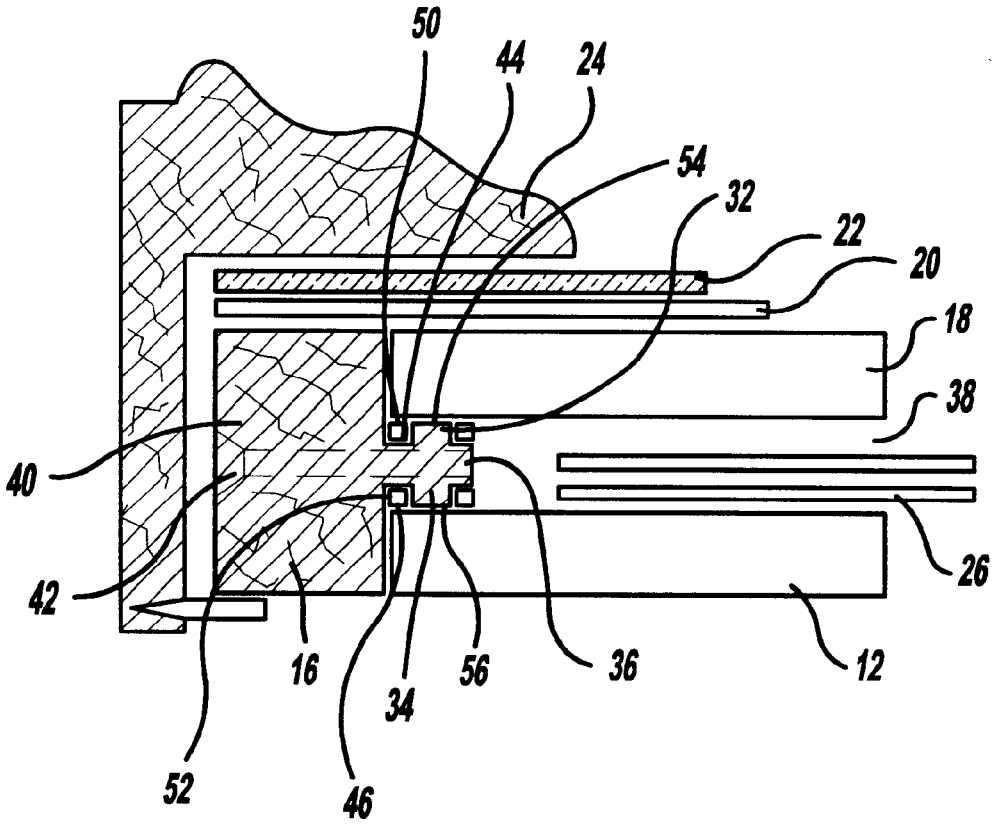
FIG. 2 is a cross sectional view of the encasement system of the present invention.

Referring to FIG. 2, there is shown the side section 16 disposed directly adjacent the transparent top section 18 and bottom section 12. The side section includes an extending arm 30. The extending arm 30 has a top segment 32 and a bottom segment 34 and a channel 36 defined there between. A cavity 38 is defined between the transparent top section 18, bottom section 12 and side sections 16 for receiving the display article 26. As shown in FIG. 2, channel 36 is in communication with cavity 38. Referring back to FIG. 1, the side section 16 extends around the periphery of the display article 26 and creates the structural means for enclosing the display article along with the top section 18 and bottom section 12. The channel 36 includes a port 40. The port 40 is designed to received a fill cap 42.

Still referring to FIG. 2, the extending arm 30 includes a top sealant canal 44 defined on the top segment 32 and a bottom sealant canal 46 defined on the bottom segment 46. The top segment 32 contacts the transparent top section 18 and the bottom segment 34 contacts the bottom section 12. In operation the encasement system includes a means for attaching the transparent top section 18 and bottom section 12 to the side section 16. In the preferred embodiment, the means for attaching is an ultraviolet adhesive sealant 50. This ultraviolet adhesive 50 is disposed in the top sealant canal 44 contacting the top section and additional ultraviolet adhesive sealant 52 is disposed in the bottom sealant canal 46 contacting the bottom section. Extending arm 30 further includes a top sealant overflow canal 54 defined on the top segment 32 and a bottom sealant overflow canal 56 defined on said bottom segment for receiving an overflow of adhesive sealant 50 and 52 respectively. The sealant overflow canals allow for sufficient application of ultraviolet adhesive 50 and 52 and create a highly effective and consistent seal between the top section 18, side section 16 and bottom section 12.

Figure 4:
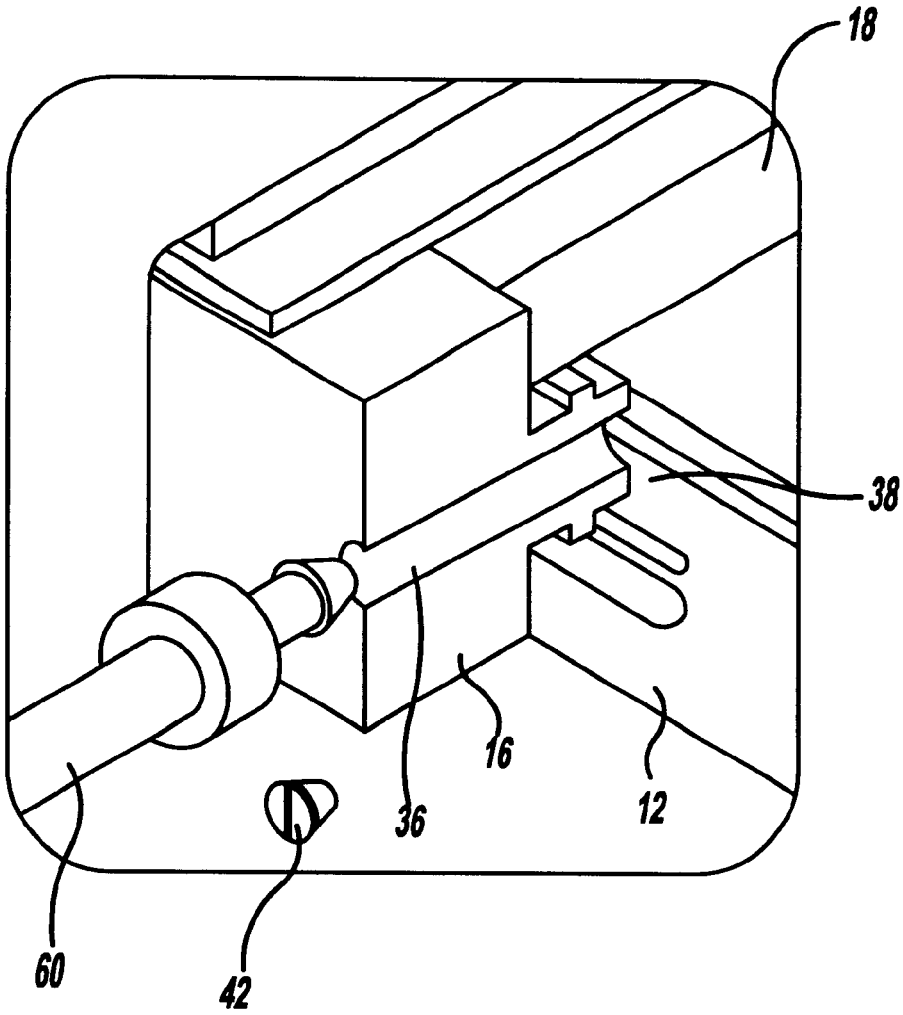
FIG. 4 is a perspective view of the encasement system of the present invention illustrating the purging mechanism.

In operation, the encasement system may be used in various manners contemplated by the present invention. For the ultimate sealing system, the present invention contemplates the purging of substantially all the air, bacteria and other foreign elements possible from the cavity 38 and the introduction of an inert gas. More specifically, referring to FIG. 4, there is shown a purging mechanism 60. The purging mechanism 60 is used to purge or extract substantially all the air possible from the cavity 38. In addition the introduction of an inert gas, in the preferred embodiment, Argon is used in the system of the present invention to create a sealed Argon gas environment within the cavity 38 to surround the article 26. In the preferred embodiment, the Argon gas will also have a water vapor content of 4% thus making the mixture introduced in the cavity approximately 96% Argon and 4% water vapor. The present invention contemplates the use of other inert gases as well as different Argon water vapor mixtures.

Figure 6:
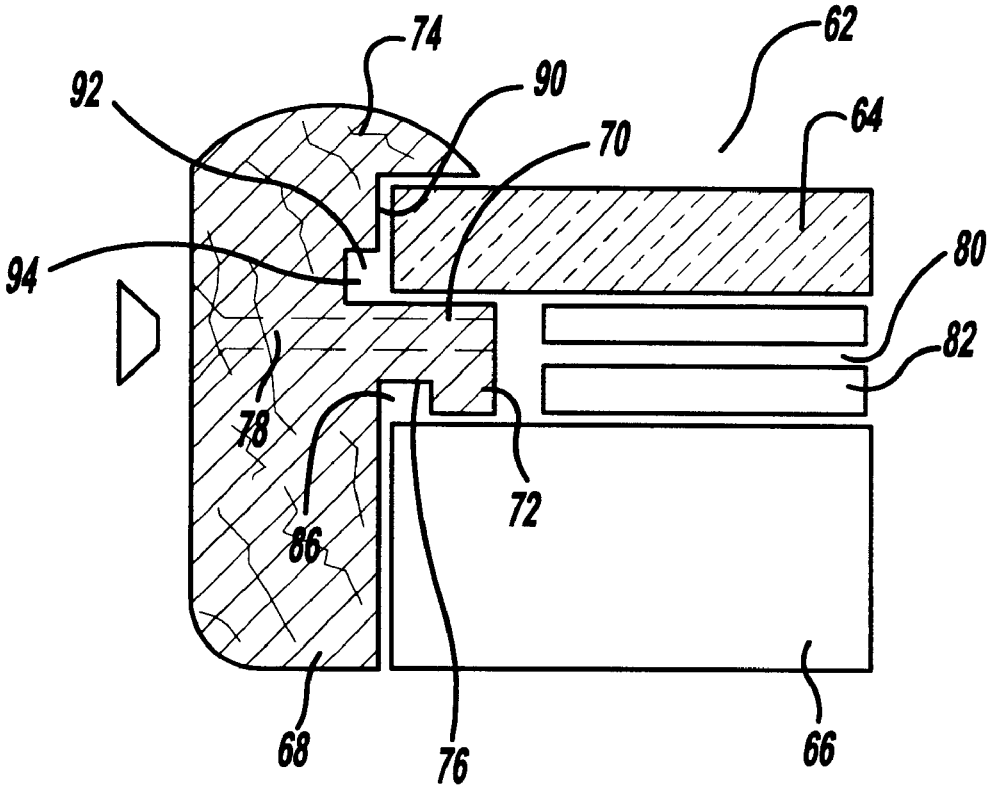
FIG. 6 is a cross sectional view of the alternative embodiment of the encasement system of FIG. 5.

Referring now to FIG. 6, there is shown an alternative embodiment of the present invention. The encasement system 62 comprises a transparent top section 64, a bottom section 66, a side section 68 disposed directly adjacent the transparent top section 64 and bottom section 66. The side section 68 includes an extending arm 70 and an extending shoulder 72. The extending arm 70 also has a top segment 74 and a bottom segment 76 and a channel 78 defined there between. A cavity 80 is defined between the transparent top section 64, bottom section 66 and side section 68 for receiving the display article 82 and whereby said channel 78 is in communication with cavity 80 and extending shoulder 72 defines a top channel 84 for receiving the top section 64.

Figure 5:
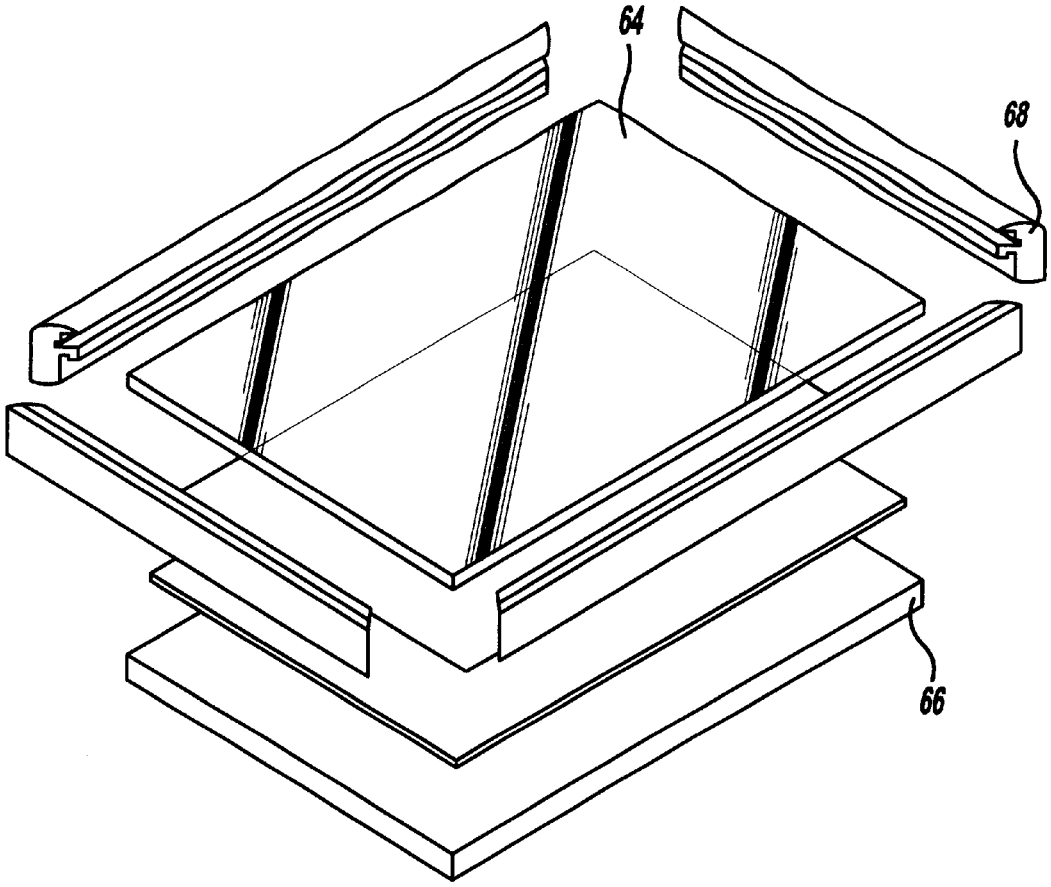
FIG. 5 is an exploded, perspective view of an alternative embodiment of the encasement system of the present invention.

Encasement system 62 also includes a bottom sealant canal 86 defined on bottom segment 72. Bottom segment 72 contacts bottom section 66 and the side section 68 further includes a sealant wall 90 disposed between the extending arm 70 and the extending shoulder. The side section 90 also contacts the top section 64 and an upper sealant canal 92 is defined between the sealant wall 90, the side section 68 and the top section 64 such when the ultraviolet adhesive 94 (as discussed above) is provided for attaching the transparent top section 64 to the bottom section 66 the ultraviolet adhesive sealant is disposed in the bottom sealant canal and contacts the bottom section and an ultraviolet adhesive sealant is disposed in the upper sealant canal and contacts the top section. FIG. 5 shows the alternative encasement system in an exploded view. The operational characteristics discussed above apply to the alternative embodiment encasement system 62 in the identical fashion.

Figure 7:
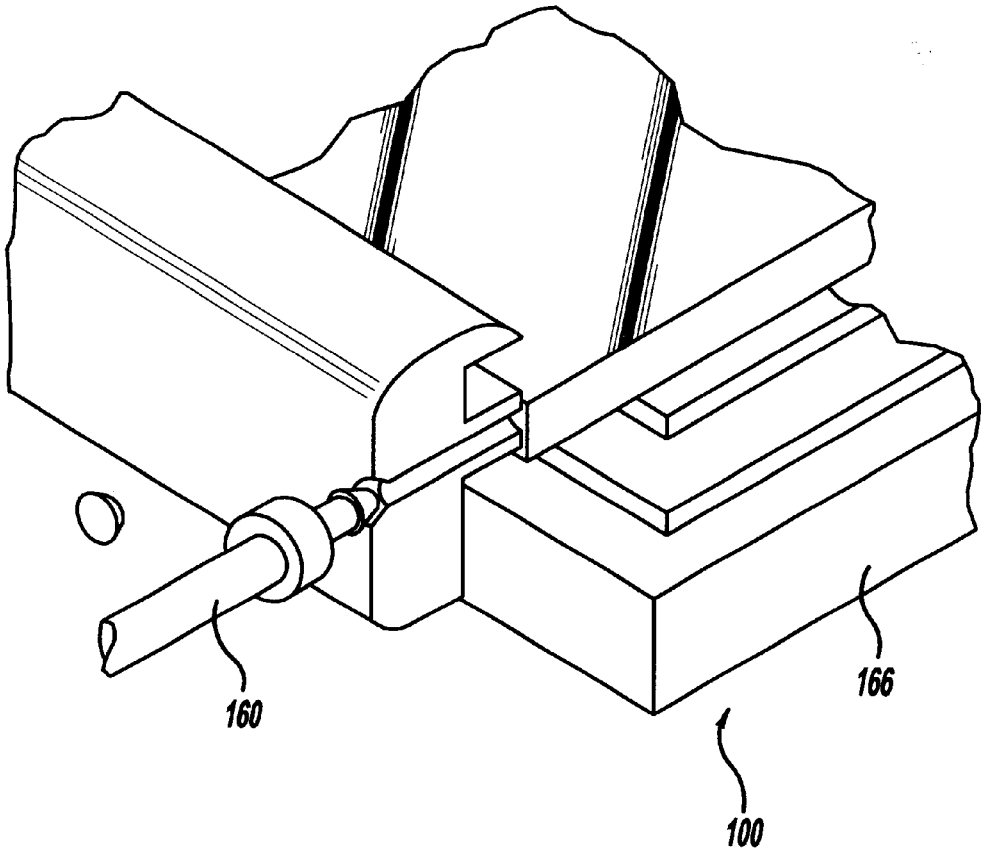
FIG. 7 is a perspective view of another alternative embodiment of the encasement system of the present invention illustrating the purging mechanism.
Figure 8:
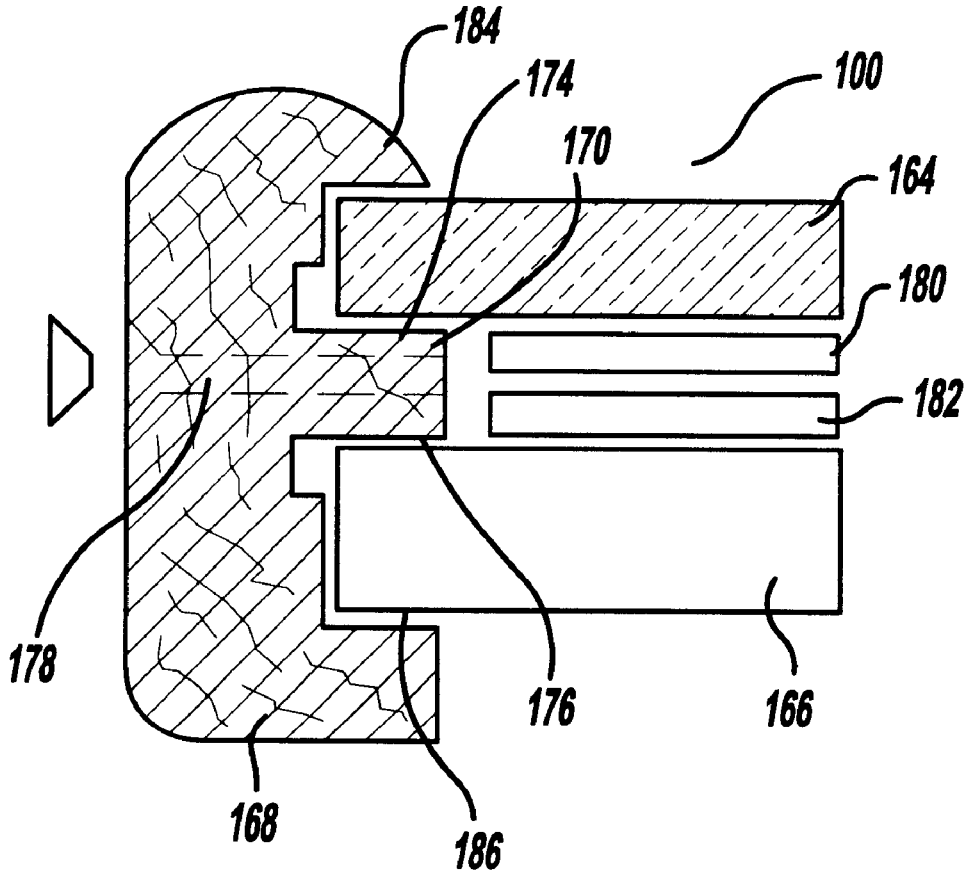
FIG. 8 is a cross sectional view of another alternative embodiment of the encasement system of FIG. 7.

Referring now to FIG. 8, there is shown yet another alternative embodiment of the present invention. Encasement system 100 is identical to encasement system 62 except that extending shoulder 72, as shown in FIG. 6 does not exist in encasement system 100. The encasement system 100 comprises a transparent top section 164, a bottom section 166, a side section 168 disposed directly adjacent the transparent top section 164 and bottom section 166. The side section 168 includes an extending arm 170. The extending arm 170 also has a top segment 174 and a bottom segment 176 and a channel 178 defined there between. A cavity 180 is defined between the transparent top section 164, bottom section 166 and side section 168 for receiving the display article 182 and where channel 178 is in communication with cavity 180 and extending arm 170 defines a top channel 184 for receiving the top section 64 and a bottom channel 186 for receiving the bottom section 166. As shown in FIG. 7 there is a purging mechanism 160. The purging mechanism 160 is used to purge or extract substantially all the air possible from the cavity 138 as discussed above.

The present invention also includes a method of protecting a display article. The method comprises the steps of providing a transparent top section and a bottom section having an integral cavity defined for receiving the display article. The bottom sections also includes a channel in communication with the integral cavity. The next step is providing a means for attaching the transparent top section to the bottom section. Next, the method includes the step of vacuuming out 90% to 99% of the available air in the integral cavity and channel and then injecting an inert gas into the integral cavity through the channel. The last step of the method is sealing the inert gas inside the cavity between the transparent top section and bottom section While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An encasement system for a display article comprising:

a transparent top section;

a bottom section;

a side section disposed directly adjacent said transparent top section and bottom section, said side section having an extending arm, said extending arm having a top segment and a bottom segment and a channel defined there between, whereby a cavity is defined between said transparent top section, bottom section and side section for receiving the display article and whereby said channel is in communication with said cavity and wherein said extending arm includes a top sealant canal defined on said top segment and a bottom sealant canal defined on said bottom segment such that said top segment contacts said transparent top section and said bottom segment contacts said bottom section;

an inert gas injected into said cavity through said channel; and an ultraviolet adhesive sealant disposed in said top sealant canal contacting said top section and an ultraviolet adhesive sealant disposed in said bottom sealant canal contacting said bottom section for attaching said transparent top section to said side section and said side section to said bottom section such that said inert gas is sealed inside said cavity between said transparent top section and bottom section and adjacent said side section.

2. An encasement system as in claim 1 wherein said inert gas is Argon.

3. An encasement system as in claim 1, wherein said transparent top section and bottom section are made from an acrylic substrate.

4. An encasement system as in claim 1, wherein said transparent top section and bottom section are made from an ultraviolet protectant acrylic substrate capable of filtering at least 90% of ultraviolet light.

5. An encasement system for a display article comprising:

a transparent top section;

a bottom section;

a side section disposed directly adjacent said transparent top section and bottom section, said side section having an extending arm, said extending arm having a top segment and a bottom segment and a channel defined there between, whereby a cavity is defined between said transparent top section, bottom section and side section for receiving the display article and whereby said channel is in communication with said cavity;

an inert gas injected into said cavity through said channel;

a means for attaching said transparent top section to said side section and said side section to said bottom section such that said inert gas is sealed inside said cavity between said transparent top section and bottom section and adjacent said side section; and an oxygen indicator filament located within said cavity.

6. An encasement system as in claim 5 wherein said extending arm further includes a top sealant overflow canal defined on said top segment and a bottom sealant overflow canal defined on said bottom segment for receiving an overflow of adhesive sealant.

* * * * *